United States Patent [19]

Farber

[11] 4,138,097

[45] Feb. 6, 1979

[54] METALLURGICAL VESSEL

[75] Inventor: Hans Farber, Oberhausen, Fed. Rep. of Germany

[73] Assignee: Gutehoffnungshütte Sterkrade Aktiengesellshaft, Oberhausen, Fed. Rep. of Germany

[21] Appl. No.: 853,878

[22] Filed: Nov. 22, 1977

[30] Foreign Application Priority Data

May 1, 1977 [DE] Fed. Rep. of Germany ..... 2703955

[51] Int. Cl.[2] ..... C21C 5/46

[52] U.S. Cl. ..... 266/241; 266/245

[58] Field of Search ..... 75/51, 52, 59, 60; 266/218, 220–224, 243–247, 265–270

[56] References Cited

U.S. PATENT DOCUMENTS 51,399 12/1865 Bessemer ..... 266/246

FOREIGN PATENT DOCUMENTS 1293832 4/1962 France ..... 266/245

812258 4/1959 United Kingdom ..... 266/244

*Primary Examiner*—Gerald A. Dost

*Attorney, Agent, or Firm*—Toren, McGeady and Stanger

[57] ABSTRACT

A metallurgical vessel, particularly for use as a converter, includes a receptacle tiltably mounted on supporting journals fitted into bushings. Media for treating the contents of the receptacle and/or for cooling the outside walls of the receptacle is fed to the receptacle by feed and delivery pipes connected at one end to a distributor and at the other end to at least one of the bushings. A plurality of bores axially extending through the bushing and connected to the delivery pipes is provided as means for communicating the media to the receptacle. The bores extend parallel to the axis of the supporting journal and are disposed in a circumferential arrangement around and coaxial with the axis of the supporting journals.

8 Claims, 5 Drawing Figures

METALLURGICAL VESSEL

BACKGROUND OF THE INVENTION

The present invention relates to metallurgical vessels used as converters, and more particularly to such a vessel which is mounted for tilting movement about supporting journals, and to the means for delivering media to the vessel for use in treating the contents within the vessel or for use in cooling the outside walls of the vessel.

The use of different gaseous and/or liquid media in the metallurgical industry for either treating metallurgical melts contained in the tiltable vessels or for cooling the outer walls of the vessels has been increasing thus requiring more and more individual feed and delivery pipes to and from the vessel for delivering the gaseous and/or liquid media. It has been typical to pass such feed and delivery pipes through one or more bores extending through the core of at least one of the supporting journals for the vessel in order to deliver the media either to the interior of the vessel or to the outside walls note DE-OS 2 034 690 DE-OS 2 065 176.

Such an arrangement, however, has the disadvantage that only a small amount of media can be fed or delivered through the journal to the interior of the vessel or to its outer walls in the event that the supporting journals become weakened as a result of the bores which extend through its core. Some metallurgical vessels have receptacles which are mounted on a supporting ring, which in turn are mounted on supporting journals for tilting the receptacle. In such vessels, opening the supporting ring and continuing the feed and delivery pipes through the supporting ring are other disadvantages. By leading the delivery and feed pipes out of the supporting ring to points on the receptacle for delivery either to the interior of the receptacle or to its outside walls tends to considerably reduce the resistance moment of the supporting ring. In addition, in such an arrangement screw couplings for the pipes and the pipes themselves leading to the receptacle are usually positioned behind the ring and become difficult to reach.

Because of the need to control the activity within the vessel and for cooling the outside walls of the vessel, it is frequently necessary to arrange as many as forty separate pipes leading to and from the vessel to provide the required media. If this number of separate feed and delivery pipes were to be conducted through a single central bore extending through one of the supporting journals, an extremely oversized central journal bore resulting in an oversized outside journal diameter, would be required to accommodate the pipes. This would not be suitable to obtain the necessary resistance moment required of the journal. When using a vessel which has a receptacle mounted on a supporting ring, a maze of pipes would exist at the outlet of the journal bore making control and arrangement of the pipes difficult.

It is accordingly a principal object of the present invention to provide a means for delivering media to the interior and/or outside walls of a receptacle for a metallurgical vessel through at least one of the supporting journals, without requiring that the pipes extend through a central bore of the journal.

Other objects, features and advantages of the present invention will become more apparent from the description of the invention in connection with the accompanying drawings to be described more fully hereinafter.

SUMMARY OF THE INVENTION

The foregoing object of the present invention is accomplished by providing a metallurgical vessel which has a receptacle tiltably mounted by a pair of supporting journals. A plurality of bores are arranged about the outside circumference of at least one of the supporting journals in a bushing fitted on the journal with the bores extending along a path coaxial to the axis of the journal, to provide a means for the passage of media to the interior of the receptacle or to its outside walls for cooling. Feed and delivery pipes are conducted from a stationary supply system through a rotatable distributor to the bores which extend through the bushing on the supporting journal. The feed and delivery pipes are connected with the plurality of bores on a side of the journal remote from the receptacle. The connections between the pipes and the bores can extend in either a radial or axial direction. Additional connecting pipes are connected with the bores on the other side of the journal (i.e. that side adjacent the receptacle) and these connecting pipes can also be connected with the bores while either extending in an axial or radial direction. The connecting pipes leading from the bores to either the interior of the receptacle or to the outside walls of the receptacle are secured either on the receptacle itself, or if the receptacle is mounted in a supporting ring, on the outside of the supporting ring so that the connecting pipes are always accessible. In addition to those bores which extend through the bushing around the supporting journal, which are required for conducting the media being fed to the receptacle, an additional number of spare bores can be provided through the bushing and which can be closed by a plug until they are ready for use. When they are ready for use, appropriate feed and delivery pipes can be connected to one side of the bore for delivering media thereto, and appropriate connecting pipes can be connected to the other side of the bore for delivering the media as desired.

BRIEF DESCRIPTION OF THE DRAWINGS

The present invention for providing the plurality of bores through the bushing, will be described in connection with the accompanying drawings, in which.

DESCRIPTION OF THE INVENTION

Referring now in more detail to the accompanying drawings the vessel illustrated is in the form of a converter and includes a receptacle 1 carried in a supporting ring 2 which is mounted for tilting movement between a pair of supporting journals 3 and 3*a*. The supporting journals 3 and 3*a* are mounted for pivotal movement in bearings 4.

Figure 2:
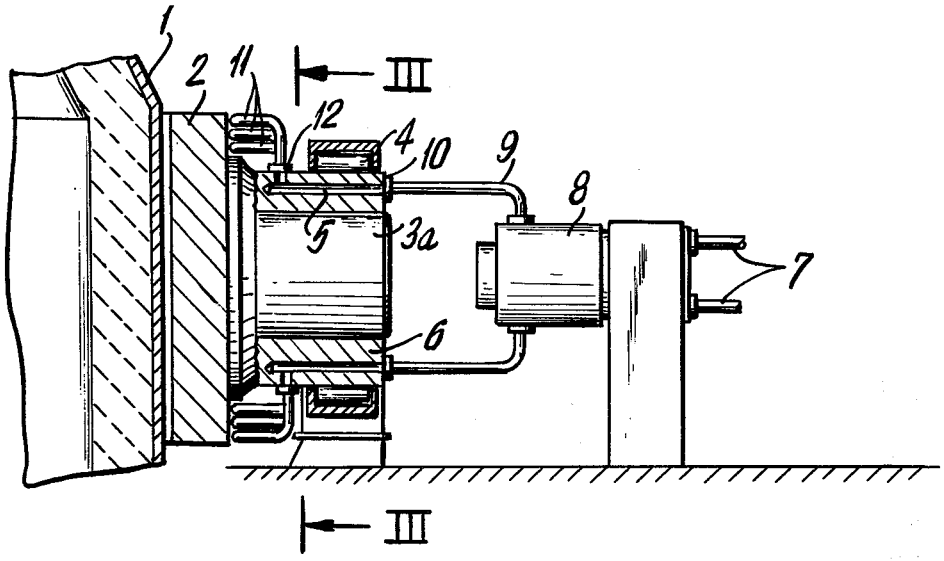
FIG. 2 is a view, partly in section, taken along line II—II of FIG. 3 illustrating the arrangement of bores through a separate bushing about one of the supporting journals.
Figure 3:
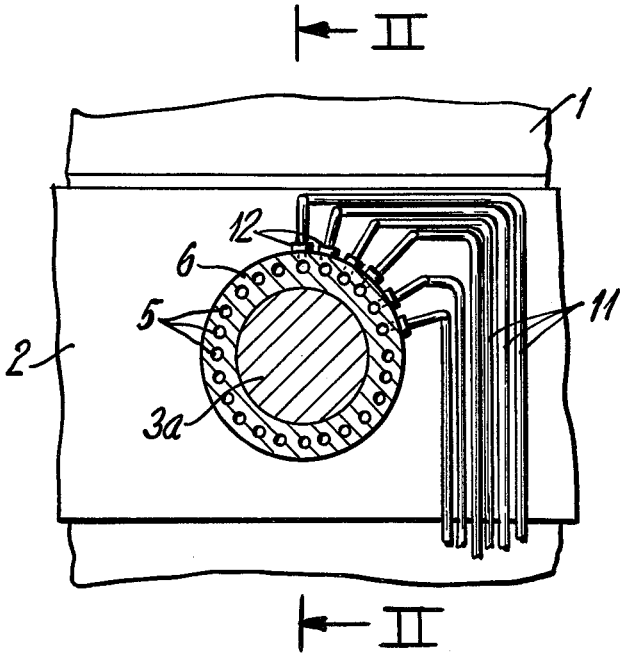
FIG. 3 is a sectional view taken along line III—III of FIG. 3.

FIGS. 2 and 3 illustrate another embodiment of the invention in which the bores 5 axially extend through a wall of a separate bushing 6. Bushing 6 is secured to the journal 3*a* in a manner well known to those skilled in the art to permit driving torque required for tilting the receptacle to be transmitted to the supporting journal and the receptacle.

Figure 1:
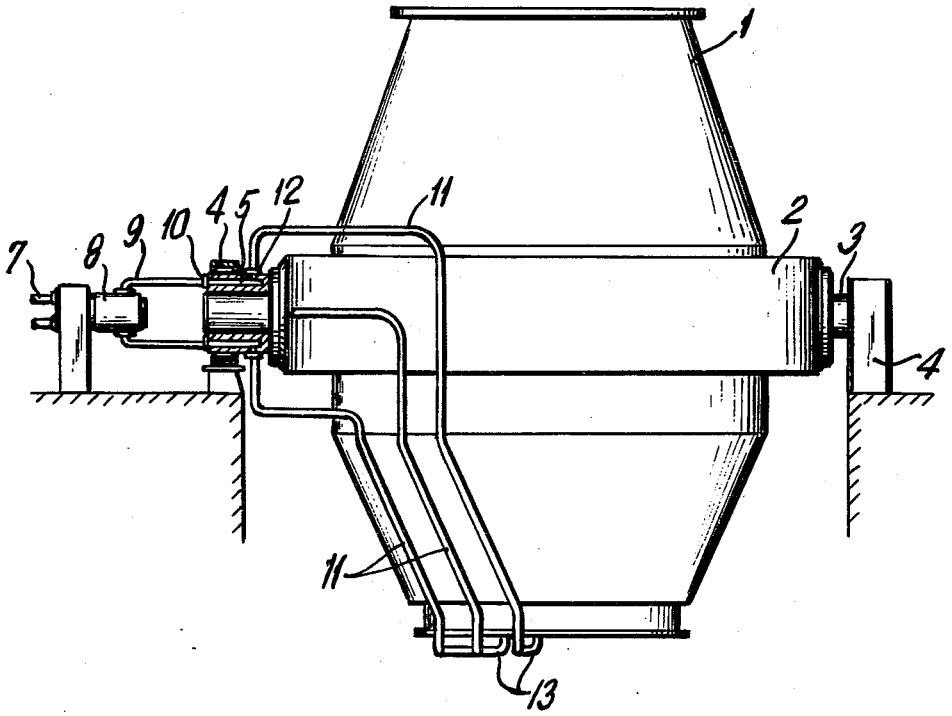
FIG. 1 is a side elevational view illustrating the vessel of the present invention.

Different types of media for treating the contents of the receptacle and/or for cooling the outer walls of the receptacle, such as oxygen, nitrogen, air, heating gas, propane, inert gas, cooling water, etc., are fed from a stationary main system 7 through a rotatably mounted distributor 8 to feed and delivery pipes 9. The feed and delivery pipes 9 are connected with the bores 5 on a side of the supporting journal 3*a* which is remote from the receptacle 1. Connecting elements 10 for connecting the pipes 9 with the bores 5 can extend in either an axial direction (as shown in the drawings) or in a radial direction. A plurality of pipes 11 are connected by connecting elements 12 to the other end of the bores 5 which extend through the bushing 6 for delivery of the media to the interior of the receptacle 1 or to its outside walls. Connecting elements 12 can be similarly connected with the bores 5 in either an axial direction or a radial direction (as illustrated in the drawings), and are secured with the bores 5 at a point outside the support ring 2. The pipes 11 extend from the connecting elements 12 around and over supporting ring 2 avoiding interference with the ring to points of use 13, such as at the bottom of the receptacle, as illustrated in FIG. 1.

It will be appreciated from the foregoing that a large number of feed and delivery pipes for delivering various types of media to the vessel can be supplied to the receptacle of the vessel without having to pass through a central bore in the supporting journals, by using the plurality of bores 5 arranged on a circumferential path coaxial with the axis of the journal.

While the present invention has been described and illustrated with respect to certain preferred embodiments which produce satisfactory results, it will be appreciated by those skilled in the art, after understanding the purposes of the invention, that various changes and modifications may be made without departing from the spirit and scope of the invention, and it is therefore intended to cover all such changes and modifications in the appended claims.

What is claimed is:

1. A metallurgical vessel for use as a converter comprising a receptacle, means for tiltably supporting said receptacle including a pair of journals forming an axis about which said receptacle is tiltable a plurality of bores extending in a direction parallel to the axis of said supporting journals and disposed in an annular arrangement coaxial with the axis of said supporting journals and providing passages for feeding media therethrough to the interior of said container for treating the contents thereof and/or for feeding media to said receptacle for cooling said receptacle, each said bore having an inlet end for receiving the media and an outlet end for supplying the media to said receptacle, a distributor, and delivery pipes each connected at one end thereof to said distributor for receiving the media therefrom and at the other end thereof to said inlet end of one of said bores wherein the improvement comprises a bushing fitted on one of said supporting journals, said plurality of bores located in and extending axially through said bushing radially outwardly from said supporting journal.

2. The metallurgical vessel according to claim 1 further comprising a plurality of connecting pipes each connected at one end thereof to the outlet end of one of said plurality of bores on the end of said bushing adjacent said receptacle and connected at the other end thereof to points of use for said media on said receptacle.

3. The metallurgical vessel according to claim 2 wherein said delivery pipes are connected to the inlet ends of said bores in the axial direction of said bushing.

4. The metallurgical vessel according to claim 2 wherein said delivery pipes are connected to the inlet ends of said bores in the radial direction of said bushing.

5. The metallurgical vessel according to claim 2 wherein said connecting pipes are connected to the outlet ends of said bores in the axial direction of said bushing.

6. The metallurgical vessel according to claim 2 wherein said connecting pipes are connected to said bores in the radial direction of said bushing.

7. The metallurgical vessel according to claim 2 further comprising a supporting ring for supporting said receptacle therein, and wherein said delivery pipes and said connecting pipes are connected to said supporting journal on the outside of said supporting ring to permit tilting movement of said vessel.

8. The metallurgical vessel according to claim 2 further comprising a plurality of spare bores extending through said bushing and the inlet and outlet ends of said spare bores being closed and being available for subsequent use.

* * * * *

UNITED STATES PATENT OFFICE

CERTIFICATE OF CORRECTION

Patent No. 4,138,097 Dated Feb. 6, 1979

Inventor(s) Hans Farber

It is certified that error appears in the above-identified patent and that said Letters Patent are hereby corrected as shown below:

In the heading of the patent [30] should read as follows:

[30] Foreign Application Priority Data

February 1, 1977 Fed. Rep. of Germany... 27 03 955

Signed and Sealed this

*Eighth* Day of *May 1979*

[SEAL]

*Attest:*

RUTH C. MASON
*Attesting Officer*

DONALD W. BANNER
*Commissioner of Patents and Trademarks*